United States Patent [19]

Steyns et al.

[11] 4,072,252

[45] Feb. 7, 1978

[54] HAND OPERATED SPRAYER WITH AUTOMATIC CONTAINER VENT

[75] Inventors: Emile B. Steyns, Helmond, Netherlands; Jerry H. Miller, Miami Lakes, Fla.

[73] Assignee: The AFA Corporation, Miami Lakes, Fla.

[21] Appl. No.: 693,383

[22] Filed: June 7, 1976

Related U.S. Application Data

[63] Continuation-in-part of Ser. No. 656,547, Feb. 9, 1976, abandoned.

[51] Int. Cl.[2] ..... B67D 5/40

[52] U.S. Cl. ..... 222/341

[58] Field of Search ..... 222/384, 383, 309, 339–341, 222/79; 239/333

[56] References Cited

U.S. PATENT DOCUMENTS

| | | | |
|---|---|---|---|
| 2,128,494 | 8/1938 | Morrow | 222/341 X |
| 2,753,079 | 7/1956 | Hersey | 222/341 X |
| 3,321,111 | 5/1967 | Jellinek | 222/341 X |
| 3,608,788 | 9/1971 | Tanaka | 222/384 |

*Primary Examiner*—Stanley H. Tollberg

*Attorney, Agent, or Firm*—Stanley A. Marcus; Thomas W. Brennan

[57] ABSTRACT

The problem of venting the interior of a liquid container utilizing an attached hand-operated, trigger sprayer of the piston or plunger pump type is solved by the provision of a vent passage in the housing of the pump which communicates with the container interior. The piston which is reciprocated in a bore or chamber in the housing has a seal means associated therewith and with the vent passage so that in operation in spraying the container is vented and vacuum development in the container is avoided. In a preferred embodiment said seal means is associated with an entrance or opening to the vent passage so as to provide a seal against liquid leakage from the container when the piston of the pump is in an at rest, non-pumping position and yet permits venting of the container when the piston is in a pumping position.

22 Claims, 2 Drawing Figures

HAND OPERATED SPRAYER WITH AUTOMATIC CONTAINER VENT

This application is a continuation-in-part of copending application Ser. No. 656,547, filed Feb. 9, 1976, now abandoned.

BACKGROUND OF THE INVENTION

1. Field of the Invention

A common problem with liquid spraying devices of the hand-operated type is the need for relief of the negative pressure created in the closed container on which the device is used as liquid is pumped. The vacuum created is relieved by venting atmospheric air into the container to displace the liquid dispensed. Various ways to do this have been proposed in the art and, in general, usually involve separate or discrete value means with or without a vent passage, and more often than not, are difficult to construct and are expensive. In addition, prior art devices are often cumbersome to use and operate.

It is also very important that the device not leak when the trigger or actuator is at rest and the container and sprayer are laid on a side or even inverted such as might be the case in normal use in spraying or in shipment where a full container might be supplied with the device when sold.

2. Description of the Prior Art

A number of patents have been issued on trigger-piston type hand sprayers useful for dispensing liquid from containers. For example, a particularly useful, and perhaps the basic, trigger type sprayer is disclosed in U.S. Pat. No. 3,061,202, issued on Oct. 30, 1962 to Tracy B. Tyler wherein venting is provided by means of a separate valve biased in the normally open position. Other patents disclosing similar sprayers also using discrete valve means for venting are U.S. Pat. No. 3,650,473, issued on Mar. 13, 1972 to Carl E. Malone, U.S. Pat. No. 3,685,739, on Aug. 22, 1972 to Vance R. Vanier, and U.S. Pat. No. 3,780,951, on Dec. 25, 1973 to Richard T. Powers. The first mentioned Malone patent vents in a manner similar to the Tyler device while the patent to Powers shows an atmospheric vent through the body of the sprayer where it attaches to the container but has a collar which is screwed down by the operator into an annular slot to close it off and thus prevent leakage of liquid from the container. Second mentioned patent to Vanier utilizes a vent passage which allows atmospheric air to flow through the sprayer's lower body past a resilient, conically-shaped hollow valve into the container.

In U.S. Pat. No. 3,840,157, issued on Oct. 3, 1974 to J. F. Hellenkamp, a trigger operated sprayer is disclosed which differs from the sprayers of the aforementioned patents in that a plunger, or piston is mounted with its axis vertically aligned and movable off a sealing collar to permit venting of a container and is an example of a lever or trigger operated vent device, as is U.S. Pat. No. 3,749,290, issued on July 31, 1973 to L. A. Micalleff, which discloses a deformable diaphragm pump system wherein a venting surface is unseated to permit atmospheric pressure to be applied to the interior of the container. Other patented devices having venting means are U.S. Pat. No. 3,701,478, issued Oct. 31, 1972, U.S. Pat. No. 3,762,647, issued Oct. 2, 1973 and U.S. Pat. No. 3,770,206, issued Nov. 6, 1973 to T. Tada; U.S. Pat. No. 3,768,734, issued Oct. 30, 1974 to I. O. Anderson, Jr., et al.; and U.S. Pat. No. 3,820,721, issued on June 28, 1974 to J. F. Hellenkamp.

The present invention provides a simple, efficient, relatively inexpensive and easy to use venting system and includes an automatic drain back feature in a pleasantly appearing structure which operates during pumping and spraying and without the empolyment of additional parts or component mechanisms.

SUMMARY OF THE INVENTION

It is, therefore, an object of the present invention to provide a vent system for a manual, trigger operated sprayer which is simple in construction, efficient in operation, and is easily and economically manufactured.

It is another object of the present invention to provide a manually operated trigger sprayer which employs no separate or discrete mechanisms or other parts for venting the container on which it is mounted, nor additional components operatively associated therewith.

It is still another object of the present invention to provide a manually operated, trigger sprayer of the foregoing type wherein liquid which may leak by a seal element may be drained back into the container rather than being permitted to leak from the sprayer.

Other objects and advantages of the present application will be apparent from the detailed description and drawings which follow.

DETAILED DESCRIPTION AND OPERATION OF THE INVENTION

Figure 1:
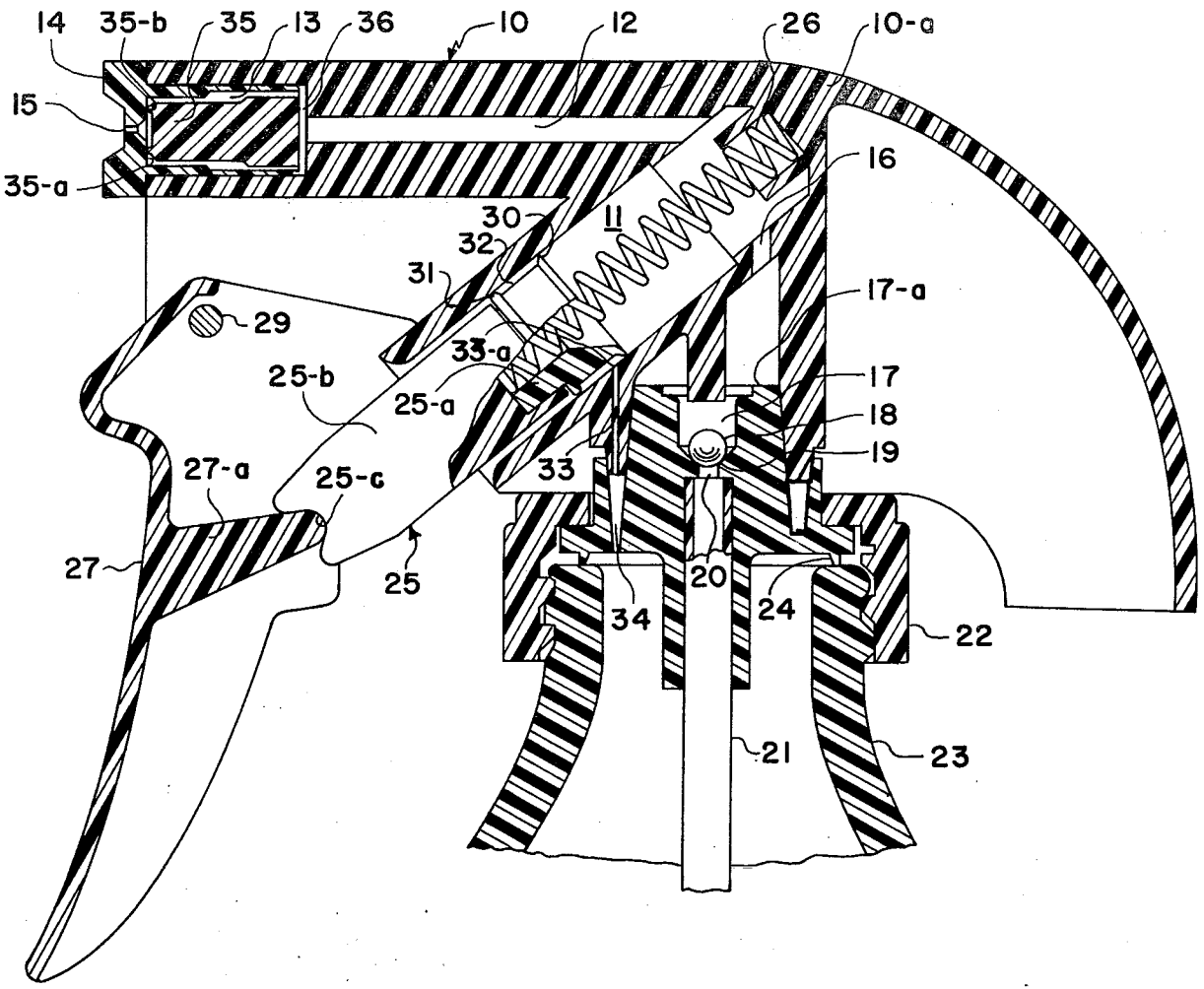
FIG. 1 is a sectional elevation of a preferred embodiment of the invention showing a trigger operated pump mechanism in its at rest or non-pumping condition.

With reference to FIG. 1, a trigger type, manually operated sprayer 10 comprising a housing or component retaining body 10-*a* having a cylindrical, hollow pump chamber or bore 11 closed at its upper end but in communication through its side wall by means of an exit or outlet passage 12 connected to a chamber 13 in a nozzle 14. Nozzle 14 has an exit orifice or "spray" nozzle opening 15. An inlet passage 16 provides communication between pump chamber or bore 11 and an inlet valve chamber 17 in an intake body portion 17-*a*. Chamber 17 contains, in sealing relation on a valve seat 19 therein, a ball check 18 in an inlet passage 20. A liquid pick-up, or dip tube 21 is fitted in air-tight relation and extends downwardly from body portion 17-*a* into a container 23 terminating near the bottom thereof (not shown). A container cap 22 is attached to body 10-*a* on body portion 17-*a* and is adapted to be clamped or screwed down onto the threaded neck portion of container 23 in liquid-tight relation therewith. A ring or lip seal 24 is formed on the bottom surface of body portion 17-*a* and mates with the top surface of container 23.

Slidably positioned for reciprocation in chamber or bore 11 is a plunger assembly 25 comprising a hollow piston 25-*a* and a carrier piece or holder 25-*b*. Holder 25-*b* has a recess 25-*c* on one end which engages an extension 27-*a* of an actuating trigger 27 mounted on body 10-*a* by means of a pivot or pin connector 29. Piston 25-*a* is fitted into a second recess in holder 25-*b* in the opposite end thereof, and in the embodiment shown, comprises a pair of spaced apart, annular circumferentially extending seals 30 and 31, the former preferably being a lip sealing angularly, rearwardly extending and sealingly contacting the wall of bore 11, whereas seal 31 preferably has a rounded, substantially circular appearance, also sealingly contacting the wall of bore 11. A compression spring 26 axially biases plunger assembly 25 in a direction away from or out of bore 11, spring 26 being mounted in bore 11 between the closed end thereof at one end and the hollow interior of piston 25-*a*, the parts described being arranged such that when at rest, as shown in the drawings, spring 26 may be under some slight compression. As is apparent from FIG. 1, when trigger 27 is actuated and pivoted about pin 29, plunger assembly 25 and piston 25-*a* reciprocate in bore 11 compressing spring 26 to initiate and maintain pumping operation of sprayer 10.

As mentioned above, in its preferred form piston 25-*a* is provided with spaced apart, peripheral lip seal 30 and annular, circular seal 31 which sealingly engage in sliding relation the inner wall of bore 11. In the at rest or non-pumping position as shown in FIG. 1, seals 30 and 31 are separated by a peripheral space or groove 32 and straddle the opening or entrance 33-*a* to a vent passage 33 formed in body 10-*a* in a bottom wall of chamber or bore 11. Passage 33 extends from space or groove 32 to one or more vertical passages 34 (one only shown in the Figures) formed in body portion 17-*a* and provides fluid communication to the interior of container 23 from space or groove 32 permitting, as will be seen, venting of container 23.

Once again referring to FIG. 1, it should be readily apparent that the present invention includes within its scope and is just as readily operated with a single seal on piston 25-*a*, which, preferably, would be forward lip seal 30. In this instance in the at rest position shown in FIG. 1 (and FIG. 2), piston 25 may be positioned in chamber 11 so that the seal 30 is in juxtaposition with opening or entrance 33-*a* of passage 33, by which is meant that seal 30 would normally, when in the at rest position of piston 25 (or 125 of FIG. 2), be in a position proximate to entrance 33-*a* on either side thereof in or on top of said entrance 33-*a*. It would, of course, be preferred in a single seal arrangement that seal 30 (or seal 130 of FIG. 2), be juxaposed with entrance 33-*a* on the trigger 27 side thereof to retain the "no leak" advantage previously referred to and described. However, operationally, the objective of venting would still be achieved with a single seal 30 (or 130) even if said seal is arranged in a normally at rest position in juxtaposition on the opposite side of opening 33-*a* or on top of said opening. In these latter arrangements, however, some leakage may be expected in some situations such as when sprayer 10 and container 23 is inverted or laid on its side. It is, of course, possible to modify sprayer 10 somewhat to avoid this eventuality in any of several well-known ways (not shown). For example, passage 33 may be formed as a capillary tube of fine diameter whereby liquid leakage which might occur will be insignificant, yet air passage will be uninhibited. Another means for obviating or mitigating against such possible leakage is the use of materials well-known to those skilled in the art in passage 33 which permit gas or air flow but inhibit or prevent liquid flow. Lastly mechanical devices such as check valves (not shown) may be employed in passage 33 or 34 to prevent liquid out flow while still permitting air flow in the opposite direction to vent container 23.

In operation of the FIG. 1 or preferred embodiment of the invention, container 23 is filled with liquid and sprayer 10 is attached by clamping or screwing down cap 22 onto the neck of container 23 with dip tube 21 extending below the liquid surface. A liquid-tight seal is obtained by seal ring 24 on the top surface of container 23 when cap 22 is screwed down or otherwise clamped on the neck thereof. Sprayer 10 is now ready for spraying liquid by grasping container 23 in the hand grip fashion, the fingers gripping trigger 27. Trigger 27 is squeezed forcing plunger assembly 25 and piston 25-*a* into bore 11 pressurizing the air therein and forcing ball 18 to close against seat 19. Air in chamber or bore 11 flows into exit or discharge conduit 12 and into chamber 13 of nozzle 14 forcing a slidable valve member 35 therein to move leftwardly. Fluid flows around valve member 35 through the radial passages formed between the vertical wall 35-*a* and ridges 35-*b* on the end of member 35 and is discharged in a spray through nozzle 14 orifice 15. When trigger 27 is released, piston 25-*a* and plunger 25 moves oppositely or leftwardly under the force of compressed spring 26, and trigger 27 returns to the "at rest" position shown. This action causes an expansion or increase in volume of chamber 11 and a slight vacuum developes which opens ball check 18 and forces valve member 35 in nozzle 14 to close against a seat 36 in chamber 13. Simultaneously liquid is drawn up into bore 11 through tube 21, chamber 17 and inlet passage 16. Seal 30 on piston 25-*a* prevents liquid leakage from chamber or bore 11, however should leakage occur liquid will flow back into container 23 through passages 33 and 34 from annular space 32, being prevented from flowing out of sprayer 10 by seal 31. Subsequent squeezing and releasing of trigger 27 repeats the above cycle except liquid is now being pumped and sprayed from container 23.

It is, however, necessary that atmospheric air be allowed to enter container 23 to make up for the volume of liquid drawn therefrom and equalize pressure therein. If venting is not allowed for, a vacuum will develope in container 23 and either liquid spray will cease or container 23 will tend to deform and/or collapse. The provision of vent passage 33 and passage 34 connected thereto in the wall of chamber or bore 11 and body portion 17-*a* respectively, permits venting communication between the interior of container 23 and the atmosphere to be established. When annular, spaced apart seals 30 and 31 are used on piston 25-*a* and straddle the entrance 33-*a* to vent 33, when trigger 27 is squeezed and piston 25-*a* moves into chamber 11, seal 31 will pass beyond opening or entrance 33-*a* to passage 33 and container 23 is vented to the atmosphere. It can be seen therefore, that the location of entrance 33-*a* to passage 33 between seals 30 and 31 in annular space 32, and closely adjacent to seal 31, permits venting of container 23 during the pumping or spraying stroke, yet in the non-pumping or "at rest" position, a positive closure for container 23 is simultaneously also provided.

Figure 2:
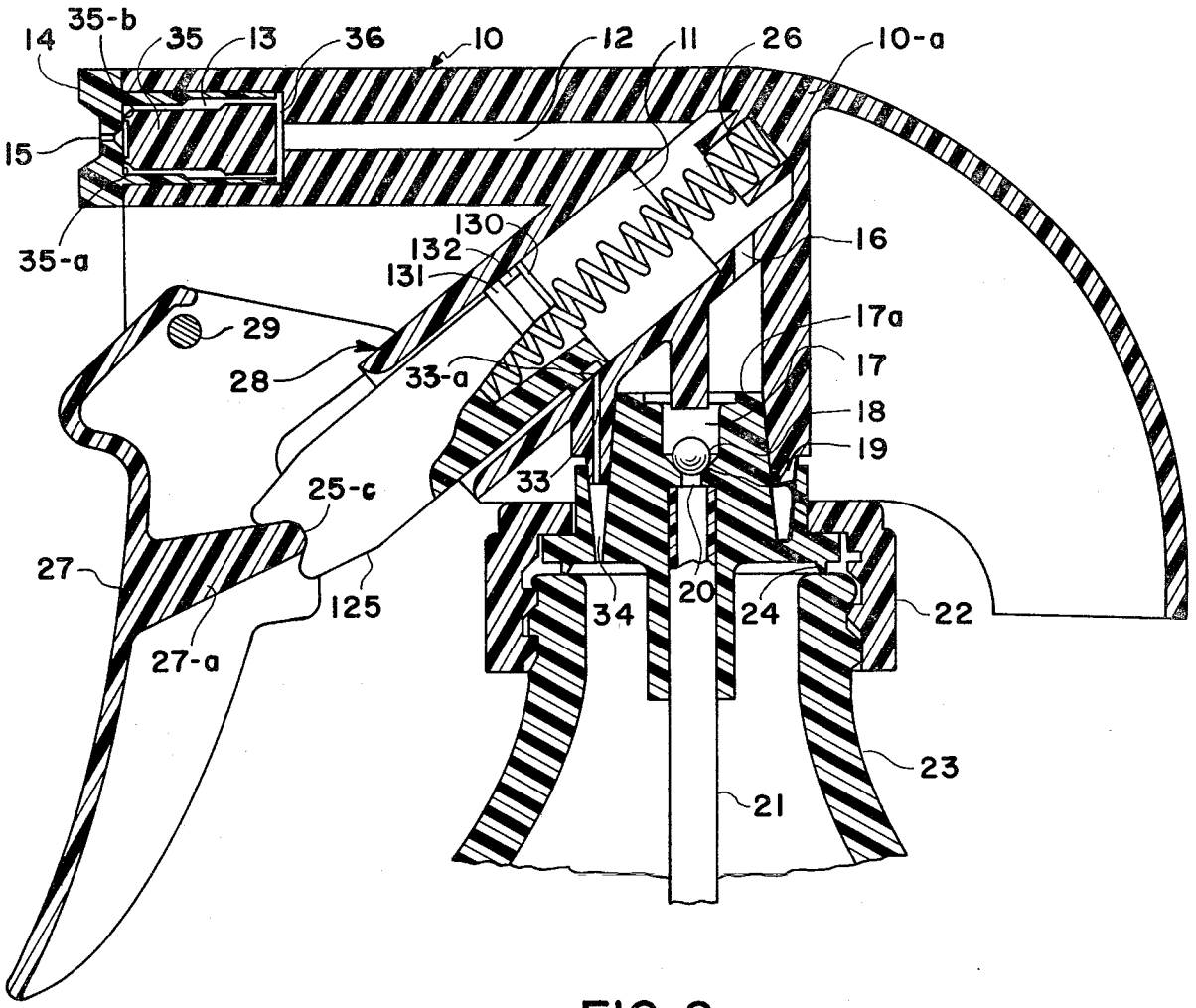
FIG. 2 is a sectional elevation, similar to FIG. 1 of another embodiment of the invention.

Referring now to FIG. 2, an additional embodiment is disclosed wherein a one-piece piston and plunger device 125 is shown. Piston or plunger 125 is preferably a single molded piece including the spaced apart, annular, circumferentially extending seals or sealing surfaces 130 and 131 separated by the peripheral, or annular recess 132, and, as shown in FIG. 2, is in the at rest position. In this position, seals 130 and 131 straddle opening or entrance 33-*a* vent passage 33 as in the preferred, FIG. 1 embodiment. In all other respects as to construction and operation, the FIG. 2 embodiment is identical with the FIG. 1 invention. In addition, while not shown herein, it is evident that seal 130 could also be formed, as by molding and the like, as a lip seal for enhanced sealing quality usually characteristic of this type seal and, due to less friction between seal and wall would provide faster return of the pump and trigger to the at rest position by compressed spring 26.

It should also be understood that a single seal element device, similar to that previously disclosed is applicable to this embodiment and such is fully contemplated. Also piston or plunger 125 can be molded with suitable annular grooves (not shown) in which O-ring type seals or the like, can be installed in place of the shown seal elements 130 and 131 with comparable beneficial results. In addition, the sealing elements associated with the piston can also be located in bore 11 remaining stationary relative to piston 25 when the latter is reciprocated. In short, any number of methods can be employed to provide the necessary sealing between piston and bore in chamber 11 and will occur to the skilled artisan. Similarly, leakage if apparent, can be dealt with in accordance with the known methods, previously described.

It is expected that the invention hereinabove described will be constructed of thermoplastic materials by any of the usual and well-known processes, for example, blow molding, injection molding, casting or the like, depending on materials used and sprayer qualities desired. Examples of suitable materials useful in carrying out the invention include any of the well-known plastics such as polystyrene, polyvinylchloride, polyurethane, the polyolefins, polyamide, polyacetate, polycarbonate, polyester and the many possible mixtures or blends thereof. A preferred material is the polyolefin, polypropylene, which has many desirable qualities including being resilient and is thus particularly useful for sealing elements or devices and for the pistons 25-*a* and 125. Other suitable materials include natural rubber, synthetic rubber, acrylonitrilebutadiene styrene (ABS) and mixtures of these and other materials. Each material will be selected in accordance with good engineering practice to maximize quality and minimize cost and expense.

What is claimed is:

1. A manually operated liquid dispenser adapted to be attached to a container holding a liquid to be dispensed comprising a. component retaining body means, the bulk of which is located outside of said container when attached thereto, b. an outwardly opening bore defined within the interior of the component retaining body means, c. a piston shiftable within the bore and bounding a variable compartment with said bore, d. inlet and outlet means disposed within the component retaining body means for delivering liquid into and out of the compartment bounded by the piston and bore, e. operating means, including a trigger normally actuated by the application of substantially horizontal force by the fingers thereto, for shifting the piston within the bore between a normal, non-pumping position and a pumping position, f. venting means extending through the body means and opening, at one end, into the bore, and g. a single unit providing seal means for the venting means, the seal means and the compartment, in normal non-pumping position, preventing communication to the ambient air from the venting means and the compartment, thereby forming a positive closure for the container, the seal means in pumping position permitting free communication between the venting means and the ambient air.

2. A dispenser according to claim 1 in which the seal means is located within the bore.

3. A dispenser according to claim 2 in which the seal means is secured circumferentially about the piston.

4. A dispenser according to claim 1 in which the seal means comprises a pair of spaced apart seals.

5. The dispenser according to claim 4 in which said seals straddle said venting means.

6. A dispenser according to claim 4 in which the spaced apart seals are secured circumferentially about the piston.

7. The dispenser according to claim 6 in which at least one of said spaced apart seals is an integral part of said piston.

8. A dispenser according to claim 4 in which the seals are integrally molded with the piston.

9. A dispenser according to claim 4 in which at least one of said seals is a lip seal.

10. A dispenser according to claim 1 in which the operating means includes resilient means to urge the piston to the normal, non-pumping position.

11. A dispenser according to claim 1 further comprising a container for retaining the liquid to be dispensed, the component retaining body means being secured upon the container so that the inlet means contacts the liquid and the venting means in pumping position extends between the ambient air and the air in the container above the liquid level.

12. The dispenser according to claim 1 in which at least the piston is a molded resilient article of a thermoplastic selected from polyethylene, polypropylene, polyurethane, acrylonitrile butadiene styrene (ABS), synthetic rubber, natural rubber, polyvinylchloride, polyacetate, polyamide, polyester and mixtures thereof.

13. A manually operated liquid dispenser adapted to be attached to a container holding a liquid to be dispensed comprising a. component retaining body means, the bulk of which is located outside of said container when attached thereto, b. a dip tube depending from said body means, c. inlet means within said body means for admitting liquid thereinto, d. outlet means including a discharge orifice located at one end of the body means remote from the inlet means to dispense liquid therefrom, e. check valve means disposed within the component retaining body means to regulate the flow of liquid, f. an outwardly opening bore defined within the interior of the body means and communicating with the inlet and outlet means, g. a piston shiftable within said bore and defining a variable volume pumping chamber therewith, h. operating means, including a trigger normally actuated by the application of substantially horizontal force by the fingers thereto, for shifting the piston within the bore between a normal, non-pumping position and a pumping position.

i. venting means extending through the body means and opening, at one end, into the bore, and j. a single unit providing seal means for the venting means and the pumping chamber, the seal means in normal non-pumping position preventing communication to the ambient air from the venting means and the pumping chamber thereby providing a positive closure for the container, the seal means in pumping position permitting free communication between the venting means and the ambient air.

14. A dispenser according to claim 13 in which the seal means comprises a pair of spaced apart seals.

15. A dispenser according to claim 14 in which the seals are secured circumferentially about said piston.

16. A dispenser according to claim 14 in which the seals are integrally molded with said piston.

17. A dispenser according to claim 15 in which at least one of said seals is a lip seal.

18. A dispenser according to claim 13 further comprising a container for retaining the liquid to be discharged, the component retaining body means being secured to said container so that the dip tube extends downwardly into the liquid and said venting means in pumping position extending between and providing communication between the ambient air and the air in the container above the liquid level.

19. A manually operated liquid dispenser adapted to be attached to a container holding a liquid to be dispensed comprising a. component retaining body means, the bulk of which is located outside of said container when attached thereto, the body means including an intake body and a trigger housing, the intake body having a circumferential groove formed therein, and the lower end of the trigger housing having an annular configuration that fits snugly within said groove, b. an outwardly opening bore defined within the interior of the component retaining body means, c. a piston shiftable within the bore and bounding a variable compartment with said bore, d. inlet and outlet means disposed within the component retaining body means for delivering liquid into and out of the compartment bounded by the piston and bore, e. operating means, including a trigger normally actuated by the application of substantially horizontal force by the fingers thereto, for shifting the piston within the bore between a normal, non-pumping position and a pumping position, f. venting means extending through the body means and opening, at one end, into the bore, g. seal means for the venting means, the seal means, in normal non-pumping position, preventing communication between the venting means and the ambient air, the seal means in pumping position permitting free communication between the venting means and the ambient air.

20. A dispenser according to claim 19 in which a flange extends circumferentially about said intake body and said body means further comprises a screw cap, the upper end of said cap resting upon said flange with the skirt of said cap depending therebelow.

21. A dispenser according to claim 19 in which the venting means comprises a first passage extending axially through the trigger housing and a second passage extending axially through said intake body, said passages being aligned with each other when the trigger housing is seated within the circumferential groove in the intake body.

22. A manually operated liquid dispenser adapted to be attached to a container holding a liquid to be dispensed comprising a. component retaining body means, the bulk of which is located outside of said container when attached thereto, the body means including an intake body and a housing, for actuating means, the intake body having a circumferential groove formed therein, and the lower end of the housing for the actuating means having an annular configuration that fits snugly within said groove, b. an outwardly opening bore defined within the interior of the component retaining body means, c. a pump means shiftable within the bore and bounding a variable compartment with said bore, d. inlet and outlet means disposed within the component retaining body means for delivering liquid into and out of the compartment bounded by the pump means and bore, e. actuating means, for shifting said pump means within the bore between a normal, non-pumping position and a pumping position, f. venting means extending through the body means and opening, at one end, into the bore, g. seal means for the venting means, the seal means, in normal non-pumping position of said pump means, preventing communication between the venting means and the ambient air, the seal means in pumping position of said pump means permitting free communication between the venting means and the ambient air.

* * * * *

UNITED STATES PATENT OFFICE

CERTIFICATE OF CORRECTION

Patent No. 4,072,252 Dated February 7, 1978

Inventor(s) Emile B. Steyns and Jerry H. Miller

It is certified that error appears in the above-identified patent and that said Letters Patent are hereby corrected as shown below:

In the specification, column 1, line 18, the word "value" should read -- valve --.

In the claims, column 5, line 68, claim 1, cancel the entire line and insert -- means and the compartment, the seal means in --.

Signed and Sealed this

Twenty-fourth Day of October 1978

[SEAL]

Attest:

RUTH C. MASON
*Attesting Officer*

DONALD W. BANNER
*Commissioner of Patents and Trademarks*

REEXAMINATION CERTIFICATE (423rd)

United States Patent [19]

Steyns et al.

[11] B1 4,072,252

[45] Certificate Issued Nov. 19, 1985

[54] HAND OPERATED SPRAYER WITH AUTOMATIC CONTAINER VENT

[75] Inventors: Emile B. Steyns, Helmond, Netherlands; Jerry H. Miller, Miami Lakes, Fla.

[73] Assignee: The AFA Corporation, Miami Lakes, Fla.

Reexamination Request:
No. 90/000,590, Jul. 12, 1984

Reexamination Certificate for:

| | |
|---|---|
| Patent No.: | **4,072,252** |
| Issued: | **Feb. 7, 1978** |
| Appl. No.: | **693,383** |
| Filed: | **Jun. 7, 1976** |

Certificate of Correction issued Oct. 24, 1978.

Related U.S. Application Data

[63] Continuation-in-part of Ser. No. 656,547, Feb. 9, 1976, abandoned.

[51] Int. Cl.[4] ..... B67D 5/40

[52] U.S. Cl. ..... 222/341

[58] Field of Search ..... 222/309, 321, 341, 339, 222/383, 385, 384, 382, 340, 79; 239/333, 349, 321

[56] References Cited

U.S. PATENT DOCUMENTS

| | | | |
|---|---|---|---|
| 2,128,494 | 8/1938 | Morrow | 222/341 X |
| 2,166,645 | 7/1939 | Shoemaker . | |
| 2,753,079 | 7/1956 | Hersey | 222/341 X |
| 3,159,316 | 12/1964 | O'Donnell . | |
| 3,185,354 | 5/1965 | Lipman . | |
| 3,194,447 | 7/1965 | Brown . | |
| 3,198,403 | 8/1965 | O'Donnell . | |
| 3,223,292 | 12/1965 | Keeney . | |
| 3,228,571 | 1/1966 | O'Donnell . | |
| 3,248,022 | 4/1966 | Schulman . | |
| 3,321,111 | 5/1967 | Jellinek | 222/341 X |
| 3,474,938 | 8/1969 | Clevenger . | |
| 3,608,788 | 9/1971 | Tanaka | 222/384 |
| 3,685,739 | 8/1972 | Vanier | 239/333 |
| 3,749,290 | 7/1973 | Micalief | 222/385 |
| 3,753,518 | 8/1973 | Kutik . | |
| 3,762,647 | 10/1973 | Tada | 239/321 |
| 3,768,734 | 10/1973 | Anderson, Jr. et al. | 239/333 |
| 3,770,206 | 11/1973 | Tada | 239/349 |
| 3,780,951 | 12/1973 | Powers | 239/333 |
| 3,907,174 | 9/1975 | Steiman . | |
| 3,908,870 | 9/1975 | Nozawa . | |
| 3,973,700 | 8/1976 | Schmidt et al. | 222/153 |
| 3,991,914 | 11/1976 | Kotuby . | |
| 4,365,751 | 12/1982 | Saito et al. | 239/333 |
| 4,480,768 | 11/1984 | Martin | 222/341 |

*Primary Examiner*—Stanley H. Tollberg

[57] ABSTRACT

The problem of venting the interior of a liquid container utilizing an attached hand-operated, trigger sprayer of the piston or plunger pump type is solved by the provision of a vent passage in the housing of the pump which communicates with the container interior. The piston which is reciprocated in a bore or chamber in the housing has a seal means associated therewith and with the vent passage so that in operation in spraying the container is vented and vacuum development in the container is avoided. In a preferred embodiment said seal means is associated with an entrance or opening to the vent passage so as to provide a seal against liquid leakage from the container when the piston of the pump is in an at rest, non-pumping position and yet permits venting of the container when the piston is in a pumping position.

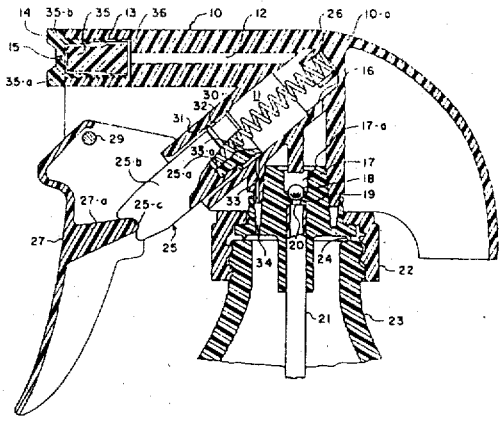

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 19–22 is confirmed.

Claims 1 and 13 are determined to be patentable as amended.

Claims 2–12 and 14–18, dependent on an amended claim, are determined to be patentable.

New claims 23–30 are added and determined to be patentable.

1. A manually operated liquid dispenser adapted to be attached to a container holding a liquid to be dispensed comprising a. component retaining body means, the bulk of which is located outside of [said] *the* container when attached thereto, b. *said component retaining body means having* an outwardly opening bore defined within the interior of the component retaining body means, c. a piston shiftable within the bore and bounding a variable compartment with said bore, d. *said component retaining body means having* inlet and outlet means [disposed within the component retaining body means] *therein* and *communicating with said bore* for delivering liquid into and out of the compartment bounded by the piston and bore *and comprising a housing having said bore therein and an intake body fixed to said housing and adapted to be coupled to the container,* e. operating means *associated with said housing*[,] *and* including a trigger *pivotally mounted to said housing and* normally actuated by application of substantially horizontal force by [the] fingers [thereto] *engaging said trigger,* for shifting the piston within the bore between a normal, non-pumping position and a pumping position, f. venting means extending through [the body means] *said housing and said intake body* and opening, at one end, into the bore *and, at another end, into the container,* and g. a single unit *incorporated into said piston for* providing seal means for the *opening of said* venting means [and the compartment] *into said bore,* the seal means in normal non-pumping position preventing communication to the ambient air from the venting means and the compartment, thereby forming a positive closure for the container, *and* the seal means in pumping position permitting free communication between the venting means and the ambient air.

13. A manually operated dispenser adapted to be attached to a container holding a liquid to be dispensed comprising a. component retaining body means, the bulk of which is located outside of said container when attached thereto, *said component retaining body means comprising a housing and an intake body fixed to said housing and adapted to be coupled to the container,* b. a dip tube depending from said *intake* body [means], c. inlet means [within] *in said intake body of* said body means for admitting liquid [therein] to said body means, d. outlet means including a discharge orifice located at one end of the *housing of the* body means remote from the inlet means to dispense liquid therefrom, e. check valve means disposed within the component retaining body means to regulate the flow of liquid, f. *said housing having* an outwardly opening bore defined [within the interior of the body means] *therein* and communicating with the inlet *means* and *the* outlet means, g. a piston shiftable within said bore and defining a variable volume punping chamber therewith, h. operating means *associated with said housing*[,] *and* including a trigger *pivotally mounted to said housing and* normally actuated by the application of substantially horizontal force by [the] fingers [thereto] *engaging said trigger,* for shifting the piston within the bore between a normal, non-pumping position and a pumping position.

i. venting means extending through [the body means] *said housing and said intake body* and opening, at one end, into the bore, and, *into the container,* and j. a single unit *incorporated into said piston* providing seal means for the *opening of said* venting means *into said bore* [and the pumping chamber], the seal means in normal non-pumping position preventing communication to the ambient air from the venting means and the pumping chamber thereby providing a positive closure for the container, *and* the seal means in pumping position permitting free communication between the venting means and the ambient air.

*23. A manually operated liquid dispenser adapted to be attached to a container holding a liquid to be dispensed comprising:*

*a. a component retaining body means, the bulk of which is located outside of the container when attached thereto;*

*b. said component retaining body means having an outwardly opening bore which is defined within the interior of said component retaining body means and which has a constant diameter over most of the length of said bore;*

*c. a piston shiftable within said bore and bounding a variable compartment within said bore;*

*d. said component retaining body means having inlet means and outlet means therein communicating with said bore for delivering liquid into and out of said compartment bounded by said piston and said bore and comprising a housing having said bore therein and an intake body fixed to said housing and adapted to be coupled to the container;*

*e. operating means, including a trigger normally actuated by the application of substantially horizontal*

*force applied by fingers engaging said trigger, said trigger being pivotally mounted to said housing to enable shifting of said piston in said bore between a normal, non-pumping position and a pumping position;*

*f. venting means extending through said housing and through said intake body and opening at one end into said bore and at another end into the container;*

*g. and a single unit incorporated into said piston for providing seal means for the opening of said venting means into said bore, said seal means and said compartment, in normal non-pumping position, preventing communication from the container to the ambient air from said venting means and from said compartment, thereby forming a positive closure for the container, and said seal means and pumping position permitting free communication from the container through said venting means to the ambient air.*

*24. The dispenser of claim 23 wherein said housing has a lower body portion, said intake body is coupled to the container and includes at least part of said inlet means, one of said intake body and said lower body portion has an annular space therein and the other of said lower body portion and said intake body is sealingly engaged in said annular space and has a first passageway forming part of said venting means and extending between said annular space and said bore or the container, and said venting means further includes a second passageway extending through said intake body or said lower body portion from said annular space to the container or to said bore.*

*25. The dispenser of claim 24 including an annular formation at the bottom of said lower body portion, and wherein said annular space is in said intake body and said annular formation is received in and sealed in said annular space in said intake body, and, said first passageway extends through said lower body portion of said housing between said bore and said annular space and said second passageway extends through said intake body between said annular space and the container.*

*26. The dispenser of claim 24 wherein said first passageway and said second passageway are not aligned and said venting means further includes a portion of said annular space between said non-aligned first and second passageways.*

*27. The dispenser of claim 24 wherein said intake body has an outwardly extending, annular mounting flange and an upwardly extending body portion, said body portion extending upwardly through an opening in the top wall of a cap threadingly received on the neck of the container and the flange being disposed beneath the top wall of the cap.*

*28. The dispenser of claim 23 wherein said seal means comprises a pair of spaced apart seals extending circumferentially about said piston and being arranged to straddle said venting means.*

*29. The dispenser of claim 23 including check valve means mounted in said inlet means in said component retaining body means and above and outside of the container for regulating the flow of liquid through the dispenser.*

*30. The dispenser of claim 23 wherein said component retaining body means includes an outlet in communication with said outlet means, a nozzle mounted to said outlet and a valve member which is associated with said nozzle, which is normally closed and which is opened under fluid pressure during pumping movement of said piston.*

* * * * *